US005634477A

United States Patent [19]

Ogura et al.

[11] Patent Number: 5,634,477

[45] Date of Patent: Jun. 3, 1997

[54] PASTE TRANSFER APPARATUS FOR A FILTER CIGARETTE MANUFACTURING SYSTEM

[75] Inventors: Shinji Ogura; Tatsuya Hasegawa, both of Tokyo, Japan

[73] Assignee: Japan Tobacco Inc., Tokyo, Japan

[21] Appl. No.: 412,738

[22] Filed: Mar. 29, 1995

[30] Foreign Application Priority Data

Mar. 31, 1994 [JP] Japan ..... 6-063707

[51] Int. Cl.[6] ..... A24C 5/24

[52] U.S. Cl. ..... 131/69; 131/35

[58] Field of Search ..... 131/35, 60, 69, 131/90; 427/359, 428; 118/200, 230, 235, 244, 258

[56] References Cited

U.S. PATENT DOCUMENTS

| | | | |
|---|---|---|---|
| 2,873,719 | 2/1959 | Schubert . | |
| 4,252,527 | 2/1981 | Hall . | |
| 4,814,204 | 3/1989 | Carey et al. . | |
| 5,398,702 | 3/1995 | Belvederi | 131/60 X |
| 5,413,806 | 5/1995 | Braun | 427/428 X |

FOREIGN PATENT DOCUMENTS

| | | |
|---|---|---|
| 1171538 | 1/1959 | France . |
| 2902913 | 7/1980 | Germany . |
| 900798 | 7/1962 | United Kingdom . |
| 1345617 | 1/1974 | United Kingdom . |

*Primary Examiner*—Jennifer Bahr

*Attorney, Agent, or Firm*—Birch, Stewart, Kolasch & Birch, LLP

[57] ABSTRACT

A paste transfer apparatus for a filter cigarette manufacturing system includes a movable guide roller and a fixed guide roller separated from each other in the traveling direction of tip paper, and a paste transfer roller is arranged between these guide rollers and disposed in rolling contact with the tip paper. A rocking arm having the movable guide roller mounted thereon is always urged in one direction by a spring, and can also be swung in the opposite direction by a rotary actuator through a swing arm and a cam follower. During operation of the manufacturing system, the rotary actuator is driven in accordance with the tip paper traveling speed under the control of a control unit, and thus the rocking arm turns to bring the movable guide roller to a position closer to or farther from the paste transfer roller, whereby the contact angle over which the tip paper is brought into contact with the paste transfer roller is varied to maintain the thickness of paste transferred to the tip paper at a required thickness.

8 Claims, 9 Drawing Sheets

PASTE TRANSFER APPARATUS FOR A FILTER CIGARETTE MANUFACTURING SYSTEM

BACKGROUND OF THE INVENTION

1. Field of the Invention

The present invention relates to a filter attachment machine for a filter cigarette manufacturing system, and more particularly, to a paste transfer apparatus incorporated in the filter attachment machine for applying paste to tip paper.

2. Description of the Related Art

In recent years tobacco with mild taste has been in demand. To meet the demand, filter cigarettes each having a filter at one end of a cigarette are on the market. Filters are attached to respective cigarettes in a filter attachment machine of a cigarette manufacturing system, by wrapping a piece of tip paper around a cigarette and a filter. To this end, typically a wrapping section provided in the filter attachment machine is supplied with filter plugs each interposed between two cigarettes, as well as pieces of tip paper applied with paste.

In connection with the supply of pieces of tip paper applied with paste, the filter attachment machine has a transport path for guiding the tip paper unrolled from a paper roll to the wrapping section, and a paste applicator is arranged so as to face the transport path for applying paste to one side of the tip paper. On the downstream side of the paste applicator, a cutter is arranged for cutting the tip paper, which has been applied with paste, into pieces with a predetermined length. The pieces of tip paper thus cut by the cutter are supplied to the wrapping section, where each piece of tip paper is wrapped around two cigarettes with a filter plug therebetween. Double-length filter cigarettes obtained in this manner, each connected by a piece of tip paper, are cut in the center of the filter plug, thereby obtaining individual filter cigarettes.

A paste transfer apparatus known in the art as the aforementioned paste applicator comprises a paste supply roller which rotates while being supplied with paste, and a paste transfer roller disposed in rolling contact with both the paste supply roller and the surface of tip paper to be applied with paste. Paste adhering to the paste supply roller is transferred via the paste transfer roller to the tip paper in the form of a layer. In order for the tip paper to be properly wound around cigarettes and filter plugs in the wrapping section of the filter attachment machine, the thickness of the paste layer transferred to the tip paper must be within a suitable range.

Conventionally, therefore, the contact angle over which the tip paper is brought into contact with the paste transfer roller is fixed so that the paste layer may have a suitable thickness when the tip paper is traveling at a set speed. Thus, while the operating conditions of the cigarette manufacturing system including the tip paper traveling speed remain the same, the paste layer formed on the tip paper by transferring paste adhering to the paste supply roller to the tip paper via the paste transfer roller has a constant thickness.

However, the operating conditions of the cigarette manufacturing system are not always the same; for example, the traveling speed of the tip paper can change. In such cases, in the conventional paste transfer apparatus in which the paste transfer roller and the tip paper are always in rolling contact at a fixed contact angle, the amount of paste transferred to the tip paper from the paste transfer roller varies. Specifically, when the tip paper traveling speed decreases below the set speed, excessive paste is transferred to the tip paper. In this case, if the paste used has high adhesive strength, the tip paper may possibly be entwined round the paste transfer roller. Conversely, when the tip paper traveling speed increases above the set speed, the paste is insufficiently transferred, possibly causing defective wrapping of the tip paper around cigarettes and filter plugs.

SUMMARY OF THE INVENTION

An object of the present invention is to provide a paste transfer apparatus which can always transfer a suitable thickness of paste to tip paper even when the operating conditions of a filter cigarette manufacturing system, particularly the traveling speed of the tip paper, are subjected to variation, thereby permitting the tip paper to be properly wrapped around cigarettes and filter plugs in the filter cigarette manufacturing system.

According to the present invention, there is provided a paste transfer apparatus for transferring paste to tip paper traveling along a tip paper transport path of a filter attachment machine of a filter cigarette manufacturing system. The paste transfer apparatus comprises first and second guide roller means separated from each other in a tip paper traveling direction for guiding the tip paper, a paste transfer roller disposed for rolling contact with the tip paper at a location between the first and second guide roller means for transferring paste supplied thereto to the tip paper, and contact angle changing means for moving at least one of the first and second guide roller means toward and away from the tip paper to change a contact angle over which the tip paper is brought into contact with the paste transfer roller.

Preferably, the contact angle changing means includes at least one rocking arm capable of rocking motion and supporting the aforesaid at least one guide roller means, and driving means for causing the rocking arm to make rocking motion. Alternatively, the contact angle changing means includes at least one movable member disposed for linear motion and supporting the at least one guide roller means, and driving means for causing the movable member to make linear motion.

Preferably, the paste transfer apparatus further comprises a detector for generating an output indicating the tip paper traveling speed, and the contact angle changing means changes the contact angle in accordance with the output of the detector. More preferably, the driving means changes the angle by which the rocking arm is turned or the distance by which the movable member is moved, in accordance with the output of the detector.

The advantage of the present invention lies in the contact angle over which the tip paper is brought into contact with the paste transfer roller can be changed by moving one or both of the first and second guide roller means toward or away from the tip paper. Accordingly, the contact angle, and thus the thickness of paste transferred from the paste transfer roller to the tip paper, can be made suitable for the operating conditions of the filter cigarette manufacturing system, in particular the tip paper traveling speed. Specifically, the contact angle can be reduced when the tip paper is traveling at low speed, and can be increased when the tip paper is traveling at high speed. Further, when the tip paper is stopped, the tip paper can be set apart from the paste transfer roller. Thus, the tip paper can always be applied with a paste layer with a constant thickness, regardless of the operating conditions of the filter cigarette manufacturing system, whereby defective wrapping of the tip paper around cigarettes and filter plugs can be prevented.

In the preferred embodiment of the invention wherein the contact angle changing means includes at least one rocking arm or movable member, and the driving means for causing the rocking arm to make rocking motion or causing the movable member to make linear motion, the contact angle can be accurately adjusted by means of the paste transfer apparatus having relatively simple arrangement.

According to the preferred embodiment of the invention wherein the contact angle (swing angle of the rocking arm) is changed in accordance with the detector output indicating the tip paper traveling speed, the contact angle over which the tip paper is brought into contact with the paste transfer roller, and thus the thickness of paste transferred to the tip paper, can be automatically adjusted so as to be suited for the tip paper traveling speed.

The above and other objects, features, and advantages of the present invention will become apparent from the following description when taken in conjunction with the accompanying drawings which illustrate preferred embodiments of the present invention by way of example.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
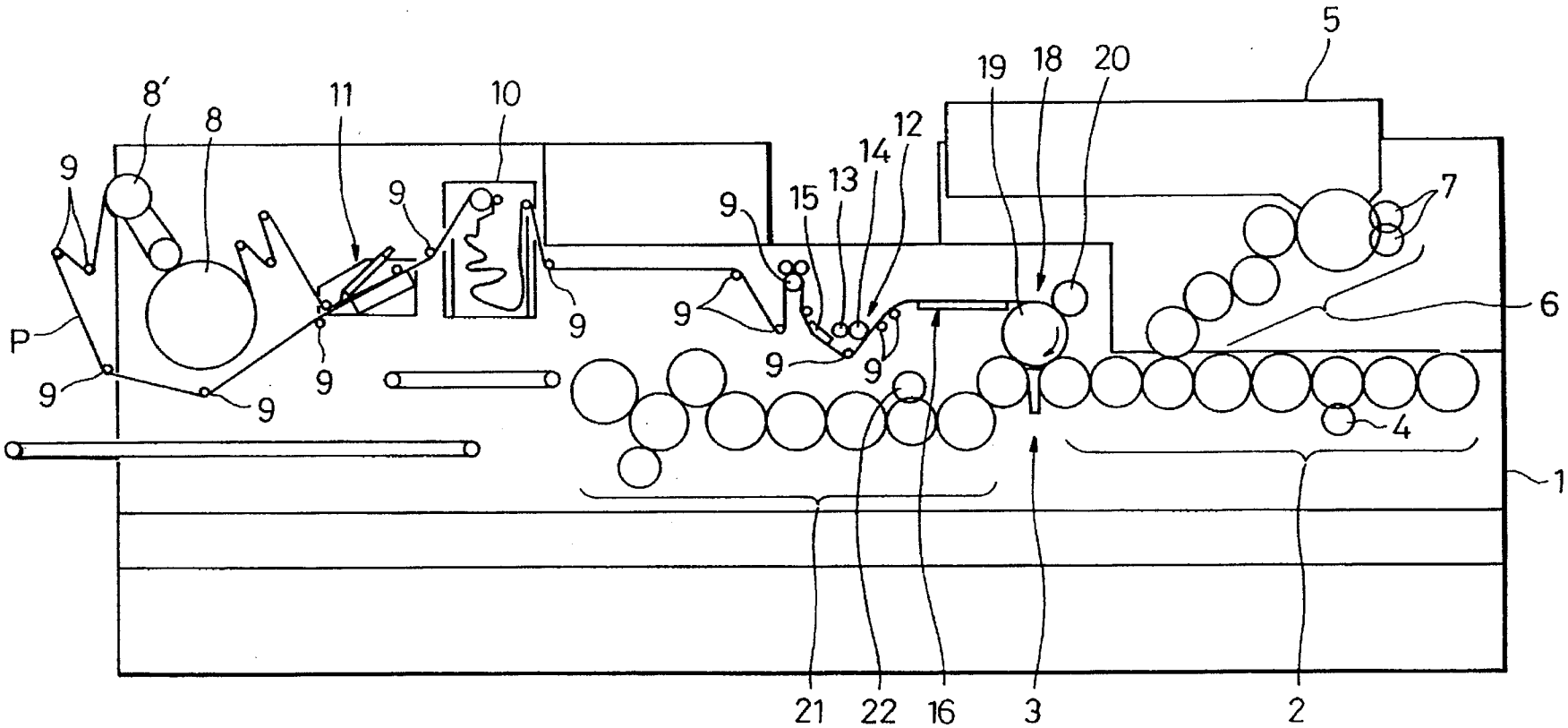
FIG. 1 is a schematic front view of a filter attachment machine of a filter cigarette manufacturing system equipped with a paste transfer apparatus according to one embodiment of the present invention.

Referring to FIG. 1, a filter attachment machine of a filter cigarette manufacturing system comprises a base frame 1. A drum train 2 composed of a large number of drums is arranged on the right-hand part of the base frame 1 as viewed in FIG. 1. Each of the drums has a number of grooves formed in the outer peripheral surface thereof at an equal distance from each other. A drum located at the upstream end of the drum train 2 adjoins a cigarette forming machine (not shown) of the cigarette manufacturing system, and cigarette rods produced by the cigarette forming machine, each having a length twice that of a cigarette, are fed into the respective grooves of the drum at the upstream end. The grooves of each drum are connected to a negative pressure generator through control valves, though not illustrated, so that negative attracting force is selectively produced in the individual grooves.

As the drums forming the drum train 2 rotate, cigarette rods fed to the drum at the upstream end are transported by a large number of intermediate drums and a drum located at the downstream end, toward a wrapping section 3 of the filter attachment machine. In this case, the negative attracting force is intermittently produced in the grooves of the individual drums at suitable timing. Due to the intermittent application of the attracting force and the rotation of the drums, cigarette rods are transferred from one drum to another adjacent thereto, that is, from the grooves of an upstream drum to those of a downstream drum.

Figure 2:
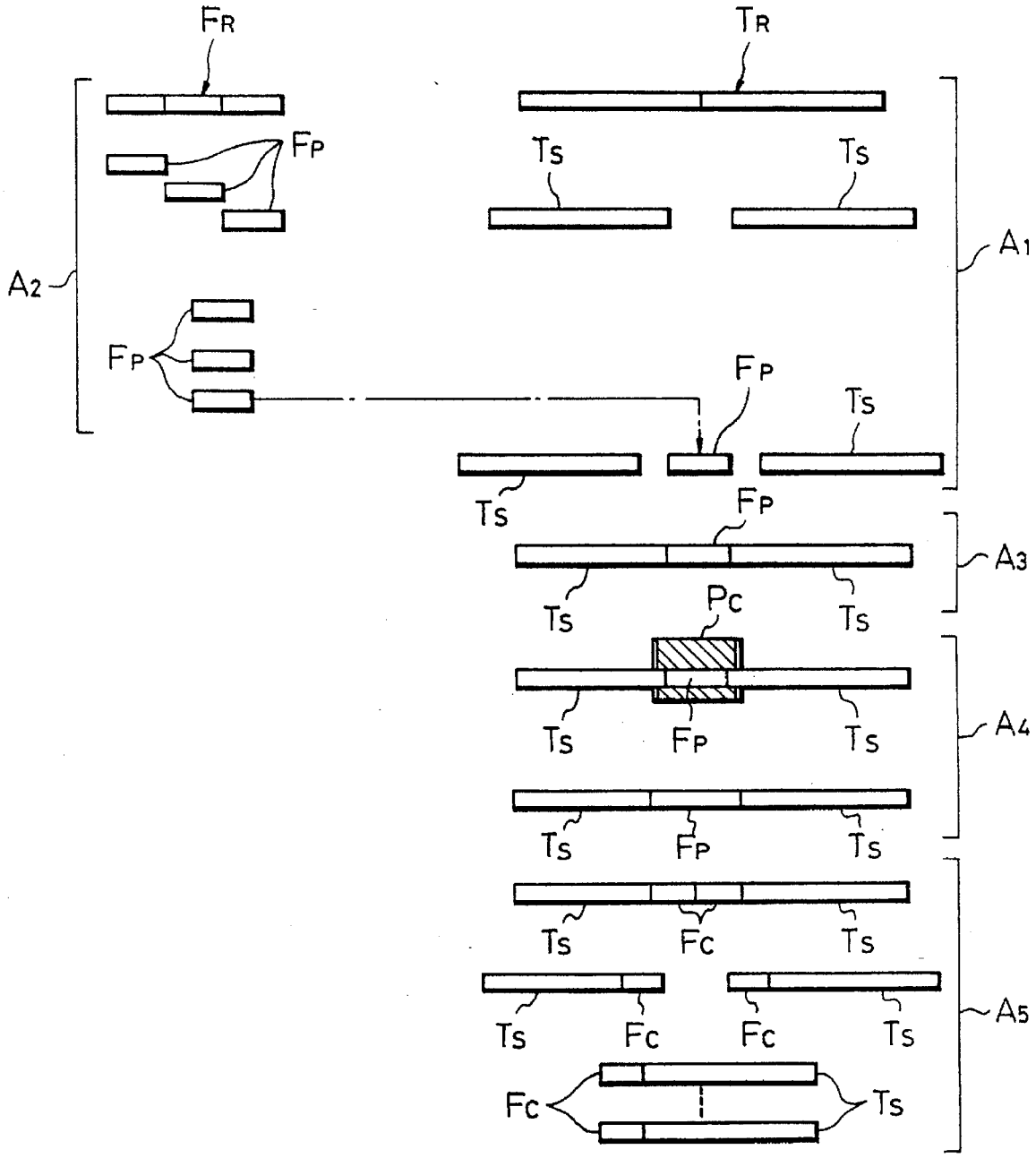
FIG. 2 is a schematic diagram illustrating a sequence of processes performed on cigarettes and filter rods in the filter attachment machine shown in FIG. 1.

While cigarette rods are transported toward the wrapping section 3 in this manner, each cigarette rod $T_R$ is cut into two equal parts, as shown in part $A_1$ of FIG. 2, by a rotary knife 4 facing one of the intermediate drums, thus obtaining two cigarettes $T_S$. Further, the two cigarettes $T_S$ are set apart from each other to provide a predetermined space therebetween while they are transported toward the wrapping section 3.

Referring again to FIG. 1, a hopper 5 is arranged above the drum train 2 and contains a large number of filter rods. A drum train 6 similar to the drum train 2 extends between the hopper 5 and an intermediate drum of the drum train 2 located more downstream than the intermediate drum facing the rotary knife 4.

Filter rods $F_R$ are fed from the hopper 5 into the grooves of a drum located at the upstream end of the drum train 6, and as this drum rotates, each filter rod $F_R$ is cut into, for example, three equal parts, by two rotary knives 7 facing the drum, thus obtaining three filter plugs $F_P$ with a predetermined length, as shown in part $A_2$ of FIG. 2. The filter plug $F_P$ has a length twice that of a filter chip connected to each cigarette $T_S$. The three filter plugs $F_P$ are then arranged in line in the direction of transportation of filter plugs by an intermediate drum in the drum train 6 serving as a grading drum, and transported toward the drum at the downstream end of the drum train 6.

As shown at the bottom of part $A_1$ in FIG. 2, the filter plugs $F_P$ are fed one by one from the drum located at the downstream end of the drum train 6. Each filter plug $F_P$ is placed between two cigarettes $T_S$, which have already been received in the corresponding groove of the associated intermediate drum in the drum train 2 with space therebetween, such that the filter plug is in alignment with the two cigarettes. The filter plug $F_P$ is then transported, together with the corresponding two cigarettes $T_S$, toward the wrapping section 3 by the drum train 2. The two cigarettes $T_S$ are moved toward each other on the drum located at the downstream end of the drum train 2 such that they are in close contact with the opposite ends of the filter plug $F_P$, as shown in part $A_3$ of FIG. 2. Accordingly, when the wrapping section 3 is supplied with filter plugs $F_P$ and cigarettes $T_S$ from the drum train 2, each filter plug $F_P$ is interposed between the corresponding two cigarettes $T_S$.

The filter attachment machine is further provided with a tip paper feeder for supplying paste-applied pieces of tip paper to the wrapping section 3. In FIG. 1, the feeder extends from the upper left end of the base frame 1 to the wrapping section 3, and has a pair of rolls 8 and 8' on each of which continuous tip paper P is wound. The tip paper P has a width sufficiently greater than the length of the filter plug $F_P$.

The tip paper feeder includes a large number of guide rollers 9 defining a tip paper feed path extending from the rolls 8, 8' to the wrapping section 3 and a storage section 10 arranged halfway in the feed path, and the tip paper P unrolled from the roll 8 or 8' (in FIG. 1, roll 8') is guided toward the wrapping section 3 by the guide rollers 9. The storage section 10 temporarily stores the tip paper P, in order to absorb the difference between the speed of feeding tip paper pieces at the wrapping section 3 and the speed at which the tip paper P is unrolled from the roll 8 or 8'.

Further, the tip paper feeder has a connecting section 11 arranged on the upstream side of the storage section 10 for connecting ends of the tip paper P. To the connecting section 11 is previously introduced the leading end of the tip paper P from that roll (in FIG. 1, roll 8) which is not currently supplying tip paper. When the trailing end of the tip paper P from the other roll (in FIG. 1, roll 8') which is currently supplying tip paper reaches the connecting section 11, the supply of tip paper from the roll 8' is stopped, and the trailing end of tip paper P from the roll 8' is connected to the leading end of tip paper P from the other roll 8. While the tip paper connection is carried out in this manner, tip paper is fed from the storage section 10, thus permitting continuous supply of tip paper to the wrapping section 3.

The filter attachment machine further includes a paste applicator 12 arranged in the middle of the feed path for the tip paper P. The paste applicator 12 is composed of a paste supply roller 13 and a paste transfer roller 14 which is disposed in rolling contact with the paste supply roller 13 and the tip paper P. In the paste applicator 12, the paste supply roller 13 transfers paste supplied thereto to the paste transfer roller 14 such that the paste on the roller 14 has a predetermined thickness, and the paste is then transferred from the paste transfer roller 14 to one surface of the tip paper P, as described in detail later.

A preheater 15 and a postheater 16 are arranged on immediately upstream side and downstream side, respectively, of the paste applicator 12. As seen from FIG. 1, the preheater 15 heats the surface of the tip paper P to which paste is to be applied, whereas the postheater 16 heats the opposite surface, or the non-paste surface, of the tip paper P. Accordingly, the surface of the tip paper to which paste is to be applied can be effectively dried in advance.

At the downstream end of the feed path of the tip paper P, a cutter 18 is arranged for cutting the tip paper P, which has been applied with paste, into pieces with a predetermined length. The cutter 18 is composed mainly of a receiving drum 19 having an outer peripheral surface serving as a suction surface to which negative pressure is applied, and a bladed drum unit 20 arranged in the vicinity of the receiving drum 19. The drum 19 and the unit 20 are rotatable in opposite directions but at the same peripheral speed. Although not shown in FIG. 1, cutting blades are arranged on the outer peripheral surface of the bladed drum unit 20 at an equal distance from each other in the circumferential direction thereof.

Accordingly, when the tip paper P applied with paste reaches the receiving drum 19, the surface of the tip paper P opposite to the paste-applied surface is attracted by suction to the outer peripheral surface of the receiving drum 19. As the receiving drum 19 rotates, the tip paper P thus attracted to the outer peripheral surface of the receiving drum 19 is cut into pieces by the cutting blades of the bladed drum unit 20. Then, as the receiving drum 19 rotates, the cut pieces of tip paper are supplied toward the wrapping section 3 which adjoins both the receiving drum 19 and the drum located at the downstream end of the drum train 2.

Thereafter, as shown in part $A_4$ of FIG. 2, each piece $P_C$ of tip paper supplied to the wrapping section 3 is wrapped around and pasted to the filter plug $F_P$ and the two cigarettes $T_S$ associated therewith, which are simultaneously supplied from the drum train 2, in such a manner that the tip paper piece $P_C$ covers the entire surface of the filter plug $F_P$ and the inner end portions of the two cigarettes $T_S$ adjoining the filter plug $F_P$. In part $A_4$ of FIG. 2, the paste-applied surface of the tip paper piece $P_C$ is indicated by hatching.

In the wrapping section 3, the two cigarettes $T_S$ and the filter plug $F_P$ interposed therebetween, supplied from the drum train 2, are caused to roll between the wrapping section 3 and the receiving drum 19, and during this rolling step, the tip paper piece $P_C$ is wound around the filter plug $F_P$ and the inner end portions of the cigarettes $T_S$. As a result, the two cigarettes and the filter plug are connected together, as shown in part $A_4$ of FIG. 2, thus obtaining a continuous double-length filter cigarette.

Double-length filter cigarettes are then supplied to a drum located at the upstream end of a drum train 21, which is composed of a number of grooved drums and extends to the left in FIG. 1. In the process of transportation on the drums of the drum train 21, the double-length filter cigarettes are each cut in the center of the filter plug by a rotary knife 22 facing an intermediate drum of the drum train 21, thus obtaining individual filter cigarettes (see part $A_5$ of FIG. 2). Then, as shown in part $A_5$ of FIG. 2, the individual filter cigarettes are oriented in one direction, transferred to a conveyor, and then supplied to a subsequent packaging machine (not shown) by the conveyor. In FIG. 2, $F_C$ represents a filter chip obtained by cutting the filter plug $F_P$ into two.

Figure 3:
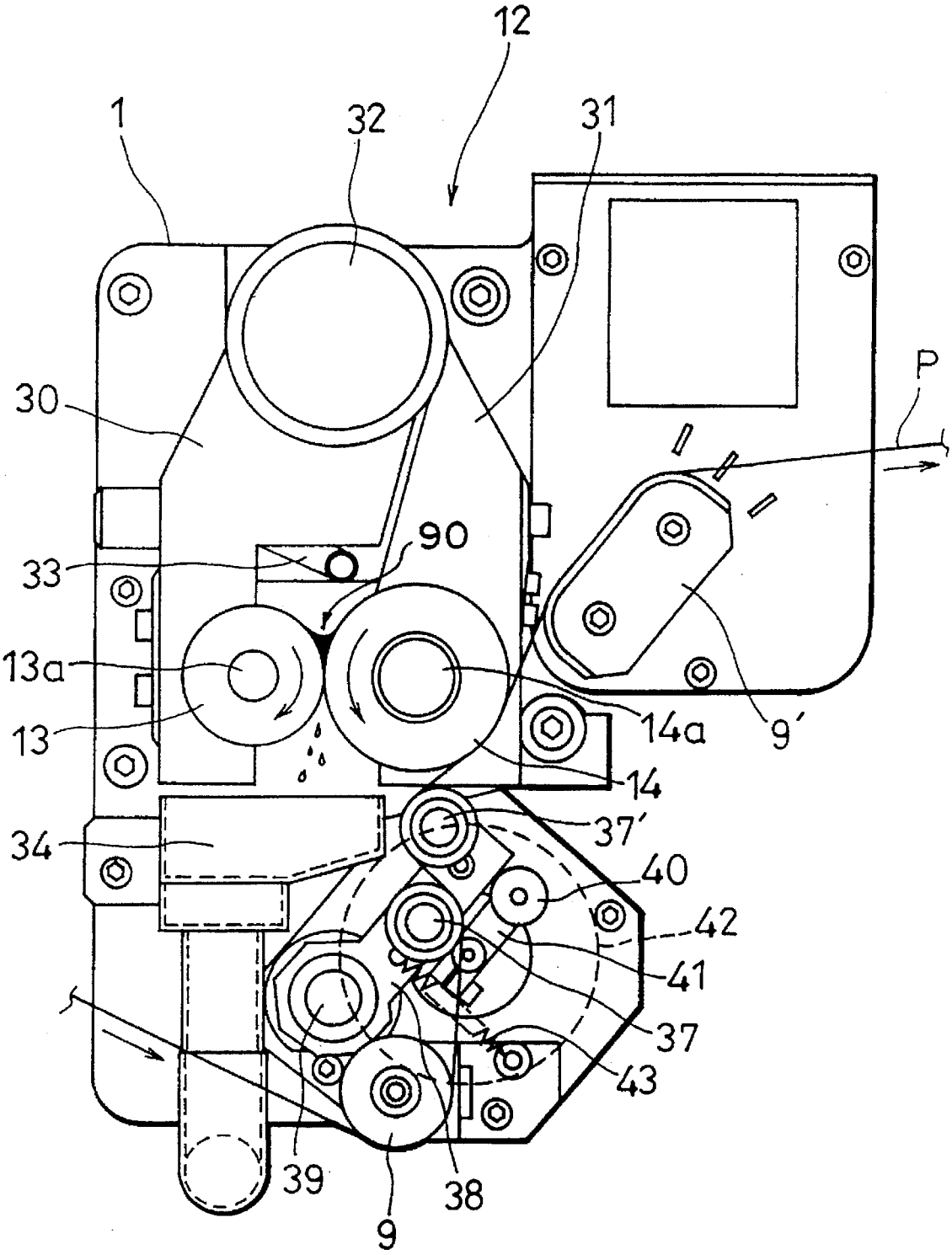
FIG. 3 is an enlarged front view of a principal part of the paste transfer apparatus shown in FIG. 1.

Referring now to FIG. 3, the paste transfer apparatus 12 outlined above with reference to FIG. 1 will be explained in detail.

As shown in FIG. 3, the paste supply roller 13 of the paste transfer apparatus 12 is rotatably supported on the lower end portion of a fixed arm 30, and the paste transfer roller 14 is rotatably supported on the lower end portion of a movable arm 31. The fixed arm 30 and the movable arm 31 have respective upper ends pivotally supported by a shaft 32 attached to the base frame 1.

The movable arm 31 is pressed toward the fixed arm 30 by a spring, not shown, so that the outer peripheral surface of the paste transfer roller 14 is in rolling contact with the outer peripheral surface of the paste supply roller 13, with a predetermined force, on one side (the left side in FIG. 3) of the roller 14 with respect to an input shaft **14*a*. A recess 90 having a depth corresponding to the thickness of a paste layer to be transferred to the tip paper P is formed in the outer peripheral surface of the paste supply roller 13 in such a manner that the recess occupies the greater part of the outer peripheral surface except for the side edge regions of the roller 13, whereby a predetermined gap corresponding to the thickness of the paste layer is defined between the outer peripheral surfaces of the paste supply roller 13 and paste transfer roller 14. On the opposite side (right-hand side in FIG. 3) of the paste transfer roller 14 with respect to the input shaft 14*a*, the surface of the tip paper P to be applied with paste is disposed in rolling contact with the outer peripheral surface of the paste transfer roller 14**.

The input shaft 14*a* of the paste transfer roller 14 is coupled to a driving system, not shown, so as to be rotated thereby in the counterclockwise direction as viewed in FIG. 3. The paste supply roller 13 has an input shaft 13*a* coupled to the input shaft 14*a* via a gear train, not shown, so that as the paste transfer roller 14 rotates, the paste supply roller 13 is rotated in the clockwise direction. Consequently, the paste supply roller 13 and the paste transfer roller 14 rotate in opposite directions. The driving system associated with the paste transfer roller 14 can change the rotational speed of the transfer roller 14 such that the peripheral speed of the paste transfer roller 14 is always equal to the traveling speed of the tip paper.

Above the rollers 13 and 14, a paste hose 33 extends between the fixed arm 30 and the movable arm 31 for supplying paste to a location between the rollers 13 and 14. As the rollers 13 and 14 rotate, paste fed from the paste hose 33 in between the rollers 13 and 14 is transferred to the paste transfer roller 14 in the form of a layer with a predetermined thickness. Surplus paste drips from the roller surface into a paste container 34 to be collected therein for reuse.

The paste transfer apparatus includes, as a plurality of guide rollers for guiding the tip paper P, a first fixed guide roller 9, a second fixed guide roller 9', and a pair of movable guide rollers 37 and 37'. The tip paper P passes between the movable guide rollers 37 and 37' while traveling from the fixed guide roller 9 to the other fixed guide roller 9'.

The first fixed guide roller 9 includes a single guide roller arranged below the paste transfer roller 14, whereas the second fixed guide roller 9' includes a pair of guide rollers arranged on the downstream side of the guide roller 9 with respect to the traveling direction of the tip paper P and located on the upper right side with respect to the paste transfer roller 14 as viewed in FIG. 3. The movable guide rollers 37 and 37' are arranged below the paste transfer roller 14 at a location between the first and second fixed guide rollers 9 and 9' with respect to the traveling direction of the tip paper, and are rotatably supported by intermediate portion and distal end portion, respectively, of a rocking arm 38.

The rocking arm 38 is pivotally supported at a proximal end thereof by a shaft 39 attached to the base frame 1. This rocking arm 38 is pulled by a spring 43 in the clockwise direction as viewed in FIG. 3. A cam follower 40, which is disposed in contact with one side surface of the distal end portion of the rocking arm 38, is rotatably mounted on a swing arm 41 fitted on the rotary shaft of a rotary actuator 42.

Accordingly, when the swing arm 41 turns together with the rotary shaft of the rotary actuator 42 in the counterclockwise direction in FIG. 3, the rocking arm 38 is pushed by the cam follower 40 mounted on the swing arm 41 to pivot on the shaft 39 in the counterclockwise direction. As a result, the movable guide rollers 37 and 37' mounted on the rocking arm 38 approach the paste transfer roller 14, whereby a contact angle over which the tip paper P is brought into contact with the paste transfer roller 14 increases. Conversely, when the swing arm 41 turns clockwise, the rocking arm 38 also turns clockwise due to the force of the spring 43; therefore, the movable guide rollers 37 and 37' move away from the paste transfer roller 14, thus reducing the contact angle.

Figure 4:
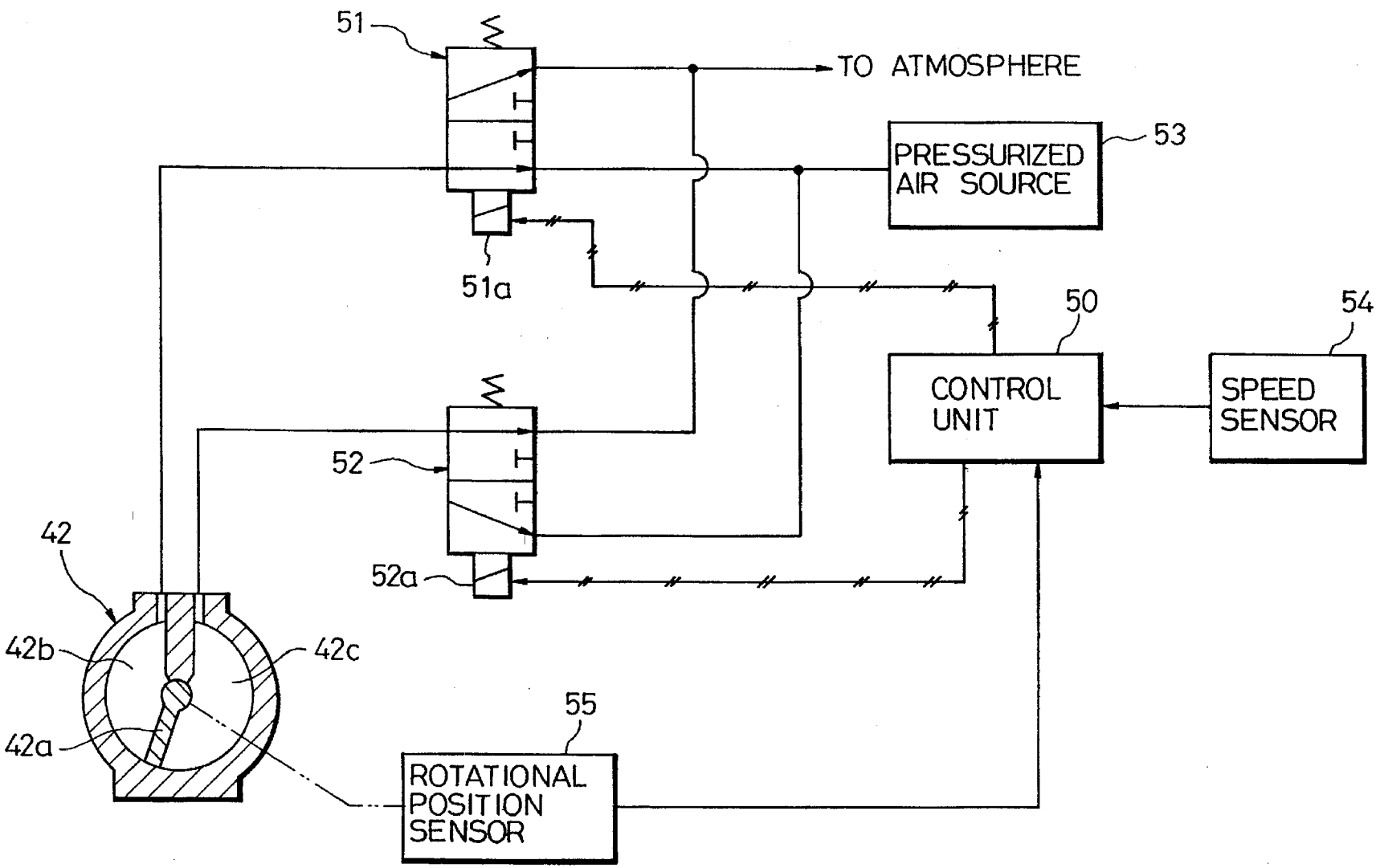
FIG. 4 is a schematic block diagram of a control section of the paste transfer apparatus shown in FIG. 3.

More specifically, the rotary actuator 42 includes, for example, a vane 42*a* rotatable together with the rotary shaft thereof, and two cylinder chambers 42*b* and 42*c* separated from each other by the vane 42*a*, as shown in FIG. 4, and the two cylinder chambers are each selectively connected to a pressurized air source 53 or the atmosphere by a corresponding one of electromagnetic valves 51 and 52 operated under the control of a control unit 50. When pressurized air is supplied to one of the cylinder chambers of the rotary actuator 42, the rotary shaft of the actuator 42 rotates.

The control unit 50 serves as driving means for causing the rocking arm 38 to make rocking motion, in cooperation with the cam follower 40, the swing arm 41, the rotary actuator 42 and the spring 43. To the input side of the control unit 50 are connected a speed sensor 54 for detecting the traveling speed of the tip paper, and a rotational position sensor 55 for detecting the rotational position of the rotary shaft of the rotary actuator 42.

The sensor 54 includes, for example, an encoder (not shown) for detecting the rotational speed of a delivery roller (not shown) for unrolling the tip paper from the roll 8, and an encoder (not shown) for detecting the rotational speed of a delivery roller (not shown) for unrolling the tip paper from the other roll 8', and each time the tip paper is unrolled from the roll 8 or 8' by a predetermined length, a pulse is output from the corresponding encoder to the control unit 50. The control unit 50 detects the traveling speed of the tip paper based on the intervals of pulses output from the speed sensor 54.

The rotational position sensor 55 comprises a rotary encoder, for example, and outputs a pair of pulses with different phases each time the rotary actuator 42 rotates by a predetermined angle. Based on the number of pulses thus output, the control unit 50 detects the rotational position of the rotary shaft of the rotary actuator 42, and also based on the relation of phase between the paired pulses, the control unit 50 detects the rotating direction of the rotary shaft of the actuator 42.

The control unit 50 has a built-in memory for storing a lookup table (not shown) which determines the rotational position of the rotary shaft of the rotary actuator 42 (hereinafter referred to as "actuator rotational position") for achieving a tip paper contact angle suited for the tip paper traveling speed (more generally, operating conditions of the cigarette manufacturing system). From the lookup table, the control unit 50 reads, as a target rotational position, an actuator rotational position corresponding to the tip paper traveling speed detected based on the output of the speed sensor 54. The control unit 50 then compares the target rotational position with an actual rotational position detected based on the output of the rotational position sensor 55, and supplies a high- or low-level control output to solenoids 51*a* and 52*a* of the electromagnetic valves to energize or deenergize the same so that the difference between the target rotational speed and the actual rotational speed becomes zero. When the solenoid 51*a* is energized to allow pressurized air to be supplied from the pressurized air source 53 to the cylinder chamber 42*b* of the rotary actuator 42 and at the same time the solenoid 52*a* is deenergized to connect the cylinder chamber 42*c* to the atmosphere, the rotary shaft of the actuator 42 rotates counterclockwise in FIG. 4. Conversely, when the solenoid 51*a* is deenergized while the solenoid 52*a* is energized, the cylinder chamber 42*c* is supplied with pressurized air whereas the cylinder chamber 42*b* is connected to the atmosphere, whereby the rotary shaft of the actuator 42 rotates clockwise.

The operation of the paste transfer apparatus 12 will be now explained.

When the cigarette manufacturing system is stopped and thus the control unit 50 is in non-operating state, the level of the control output from the control unit 50 to each of the solenoids 51*a* and 52*a* of the electromagnetic valves 51 and 52 is low. When the control unit 50 is in operating state but the tip paper P is stopped, the control unit 50 judges based on the output of the speed sensor 54 that the tip paper is stopped, and thus supplies a low-level control output to the solenoids 51*a* and 52*a*.

Figure 5:
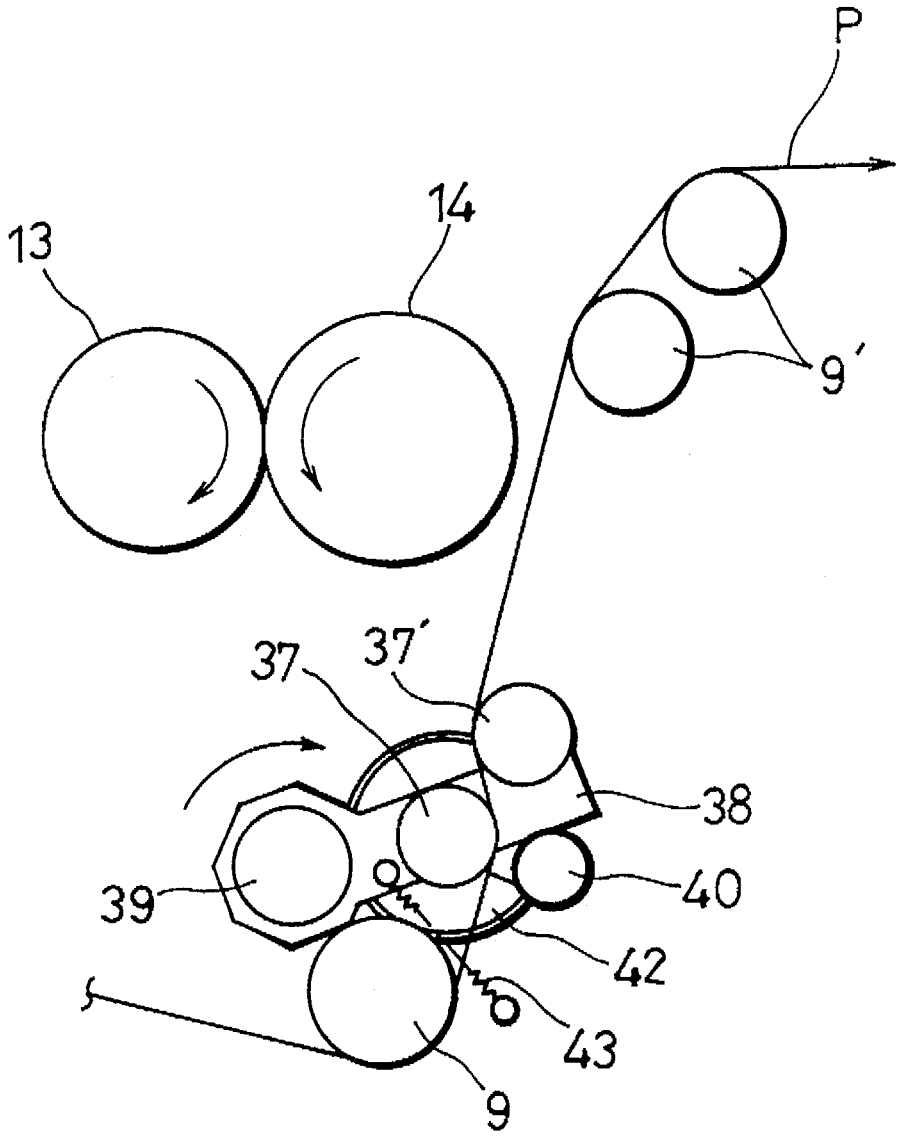
FIG. 5 is a schematic diagram illustrating the position of a paste transfer roller in relation to the position of a movable guide roller when tip paper is stopped.

When the solenoids 51*a* and 52*a* are supplied with a low-level control output and thus deenergized, the cylinder chambers 42*b* and 42*c* of the rotary actuator 42 are connected to the atmosphere; therefore, the actuator 42 is in non-operating state and produces no torque. Accordingly, no rotating force is applied to the rocking arm 38 from the actuator 42. The force of the spring 43, on the other hand, always acts upon the rocking arm 38 to rotate the same in the clockwise direction. As a result, the rocking arm 38 assumes an initial position shown in FIG. 5 where the arm 38 is swung farthest in the clockwise direction. In this case, the movable guide rollers 37 and 37', which are movable together with the rocking arm 38, are in their initial position remotest from the paste transfer roller 14 and the surface of the tip paper P to be applied with paste is separated from the outer peripheral surface of the paste transfer roller 14. In the actuator 42, a protuberance (not shown) integrally formed with the rotary shaft thereof is engaged with a stopper, not shown, whereby the rotary shaft is held at an initial position farthest in the clockwise direction.

When the tip paper P is traveling during operation of the filter cigarette manufacturing system, the control unit 50 detects the tip paper traveling speed based on the output of the speed sensor 54, and then refers to the lookup table stored in the built-in memory thereof to read a target rotational position for the rotary shaft of the actuator 42 corresponding to the detected traveling speed of the tip paper. While at the same time, an actual rotational position of the rotary shaft of the actuator is detected based on the output of the rotational position sensor 55, and compared with the target rotational speed.

If the actual rotational position is deviated in the clockwise direction from the target rotational position, the control unit 50 supplies high- and low-level control outputs, respectively, to the solenoids 51*a* and 52*a* of the electromagnetic valves. As a result, the cylinder chamber 42*b* of the rotary actuator 42 is supplied with pressurized air and the other cylinder chamber 42*c* is connected to the atmosphere, whereby the rotary shaft of the actuator rotates counterclockwise due to the difference of internal pressure between the cylinder chambers. As the rotary shaft of the actuator rotates counterclockwise, this rotating force acts upon the rocking arm 38 through the swing arm 41 and the cam follower 40; therefore, the rocking arm 38 turns counterclockwise against the clockwise force exerted by the spring 43. Consequently, the movable guide rollers 37 and 37' mounted on the rocking arm 38 move toward the paste transfer roller 14.

On the other hand, when the actual rotational position is deviated in the counterclockwise direction from the target rotational position, the control unit 50 supplies low- and high-level control outputs, respectively, to the solenoids 51*a* and 52*a*. As a result, the cylinder chamber 42*b* is connected to the atmosphere and the cylinder chamber 42*c* is supplied with pressurized air, whereby the rotary shaft of the actuator rotates clockwise. As the rotary shaft rotates clockwise, the swing arm 41 and the cam follower 40 also rotate in the clockwise direction. The rocking arm 38 is always applied with the clockwise force of the spring 43, and accordingly, turns clockwise with the clockwise rotation of the cam follower 40 and swing arm 41. Consequently, the movable guide rollers 37 and 37' move away from the paste transfer roller 14.

In this manner, the rotary shaft of the rotary actuator 42 assumes the target rotational position suited for the tip paper traveling speed.

Accordingly, when the cigarette manufacturing system is started and the tip paper P starts traveling, the rotary shaft of the rotary actuator 42 rotates counterclockwise from the aforementioned initial position, and thus the movable guide rollers 37 and 37' move toward the paste transfer roller 14 from their initial position. As a result, the surface of the tip paper P to be applied with paste is brought into contact with the outer peripheral surface of the paste transfer roller 14.

When the cigarette manufacturing system thereafter reaches a steady operating state in which the tip paper P travels at a set speed, the rotary shaft of the actuator 42 assumes a rotational position suited to the set traveling speed under the control of the control unit 50, so that the position of the movable guide rollers 37 and 37' relative to the paste transfer roller 14, and thus the contact angle over which the tip paper P is brought into contact with the paste transfer roller 14, is suited for the set traveling speed of tip paper. Consequently, paste on the paste transfer roller 14 is transferred to the surface of the tip paper P in the form of a layer with a desired thickness.

Even when the operating state of the cigarette manufacturing system changes from the steady operating state, particularly when the tip paper traveling speed changes from the set speed, the thickness of the paste layer can be maintained at a desired value.

Figure 6:
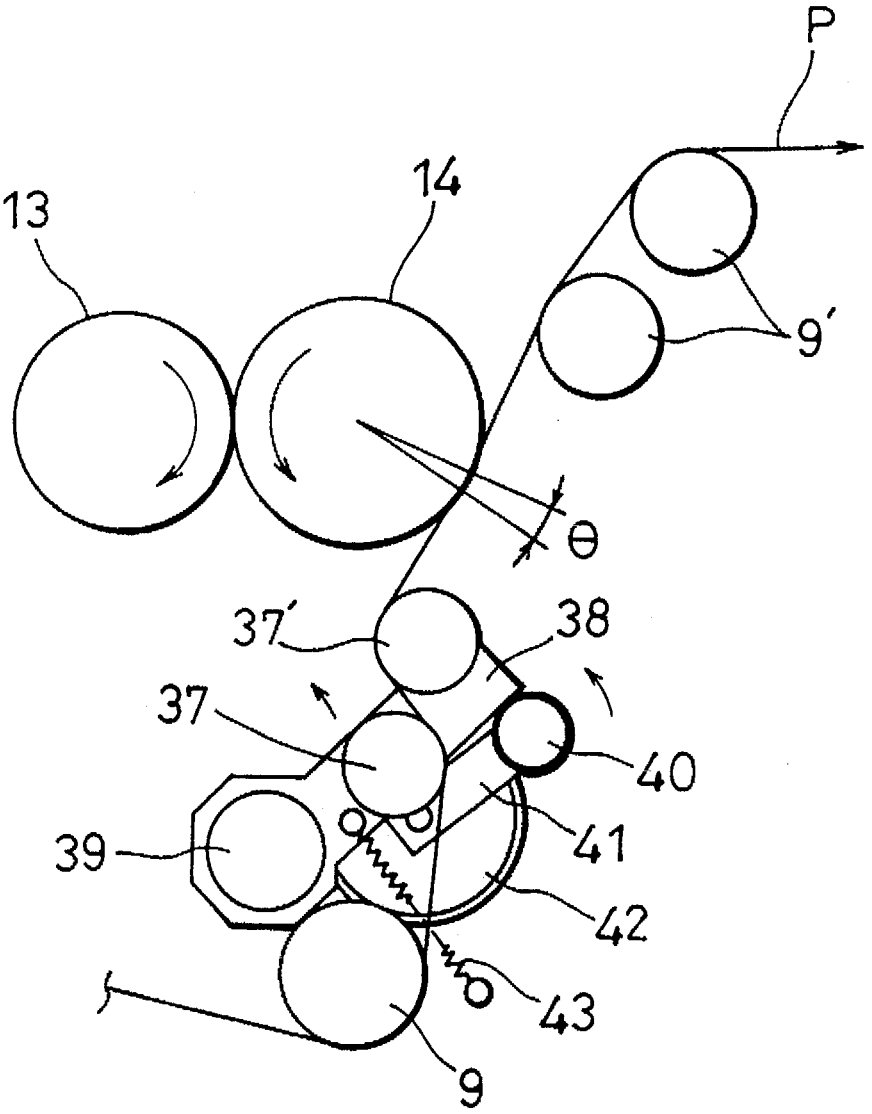
FIG. 6 is a diagram similar to FIG. 5, illustrating the position of the paste transfer roller in relation to the position of the movable guide roller when the tip paper is traveling at low speed.

Specifically, when the tip paper traveling speed decreases below the set speed, the target rotational position for the rotary shaft of the rotary actuator 42 is changed in the clockwise direction from the normal target rotational position in accordance with the decreased traveling speed of tip paper. In this case, the rotary shaft of the actuator rotates clockwise from the normal rotational position under the control of the control unit 50, in the manner described above, and thus the movable guide rollers 37 and 37' move away from the paste transfer roller 14. As a result, the contact angle over which the tip paper P is brought into contact with the paste transfer roller 14 decreases, and the paste transfer roller 14 is disposed in rolling contact with the tip paper P over a predetermined angle $\theta$ smaller than a normal contact angle (not shown), as shown in FIG. 6. Consequently, paste is prevented from being excessively transferred from the paste transfer roller 14 to the tip paper P due to decrease of the tip paper traveling speed, and the thickness of the paste layer can be maintained at the desired value.

Figure 7:
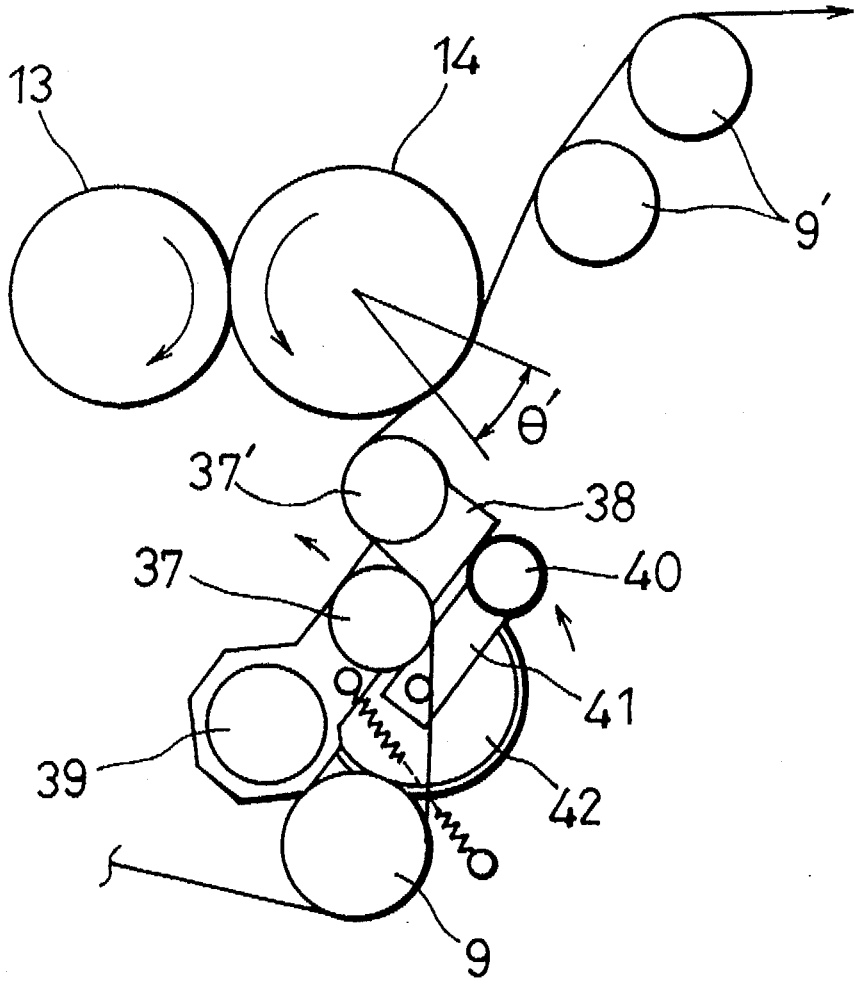
FIG. 7 is a diagram similar to FIGS. 5 and 6, illustrating the position of the paste transfer roller in relation to the position of the movable guide roller when the tip paper is traveling at high speed.

Conversely, when the tip paper traveling speed increases above the set speed, the target rotational position for the rotary shaft of the rotary actuator 42 is changed in the counterclockwise direction from the normal target rotational position in accordance with the increased traveling speed of tip paper. In this case, the rotary shaft of the actuator rotates counterclockwise from the normal rotational position under the control of the control unit 50, and thus the movable guide rollers 37 and 37' move toward the paste transfer roller 14. As a result, the contact angle over which the tip paper P is brought into contact with the paste transfer roller 14 increases, and the paste transfer roller 14 is disposed in rolling contact with the tip paper P over a predetermined angle $\theta'$ greater than the contact angle $\theta$ at low traveling speed (FIG. 6) and the normal contact angle (not shown), as shown in FIG. 7. Consequently, paste is prevented from being insufficiently transferred from the paste transfer roller 14 to the tip paper P due to increase of the tip paper traveling speed, and the thickness of the paste layer can be maintained at the desired value.

As mentioned above, the contact angle over which the tip paper P is brought into contact with the paste transfer roller 14 is variably controlled in accordance with the tip paper traveling speed (more generally, the operating conditions of the cigarette manufacturing system). Accordingly, the amount of paste transferred from the paste transfer roller 14 to the tip paper P per unit time can be changed, and thus a paste layer with a constant thickness can be transferred to the tip paper P. Consequently, defective wrapping of the tip paper P can be prevented.

The present invention is not limited to the above embodiment, and various modifications are possible.

For example, in the above embodiment, the first and second guide roller means comprise a pair of movable guide rollers 37 and 37' arranged on the upstream side of the paste transfer roller 14 with respect to the traveling direction of tip paper and the second fixed guide roller 9' arranged on the downstream side of the roller 14 and including a pair of guide rollers, but the guide roller means are not limited to this arrangement. Any guide roller means may be used as the first and second guide roller means of the present invention, insofar as it comprises guide roller means arranged on the upstream side of the paste transfer roller and including one or more guide rollers and guide roller means arranged on the downstream side of the same roller and including one or more guide rollers and at least one of these two guide roller means is movable toward and away from the tip paper so as to change the contact angle over which the tip paper is brought into contact with the paste transfer roller.

Accordingly, the guide roller means arranged on the upstream and downstream sides of the paste transfer roller may be both movable; alternatively, the guide roller means arranged on the upstream side of the paste transfer roller may include a fixed guide roller whereas the guide roller means arranged on the downstream side of the paste transfer roller may include a movable guide roller.

Further, the contact angle changing means of the embodiment includes the rocking arm 38 and the driving means composed of the cam follower 40, swing arm 41, rotary actuator 42, spring 43 and control unit 50 for causing the rocking arm 38 to make rocking motion, but the construction of the contact angle changing means is not limited to this alone.

Figure 8:
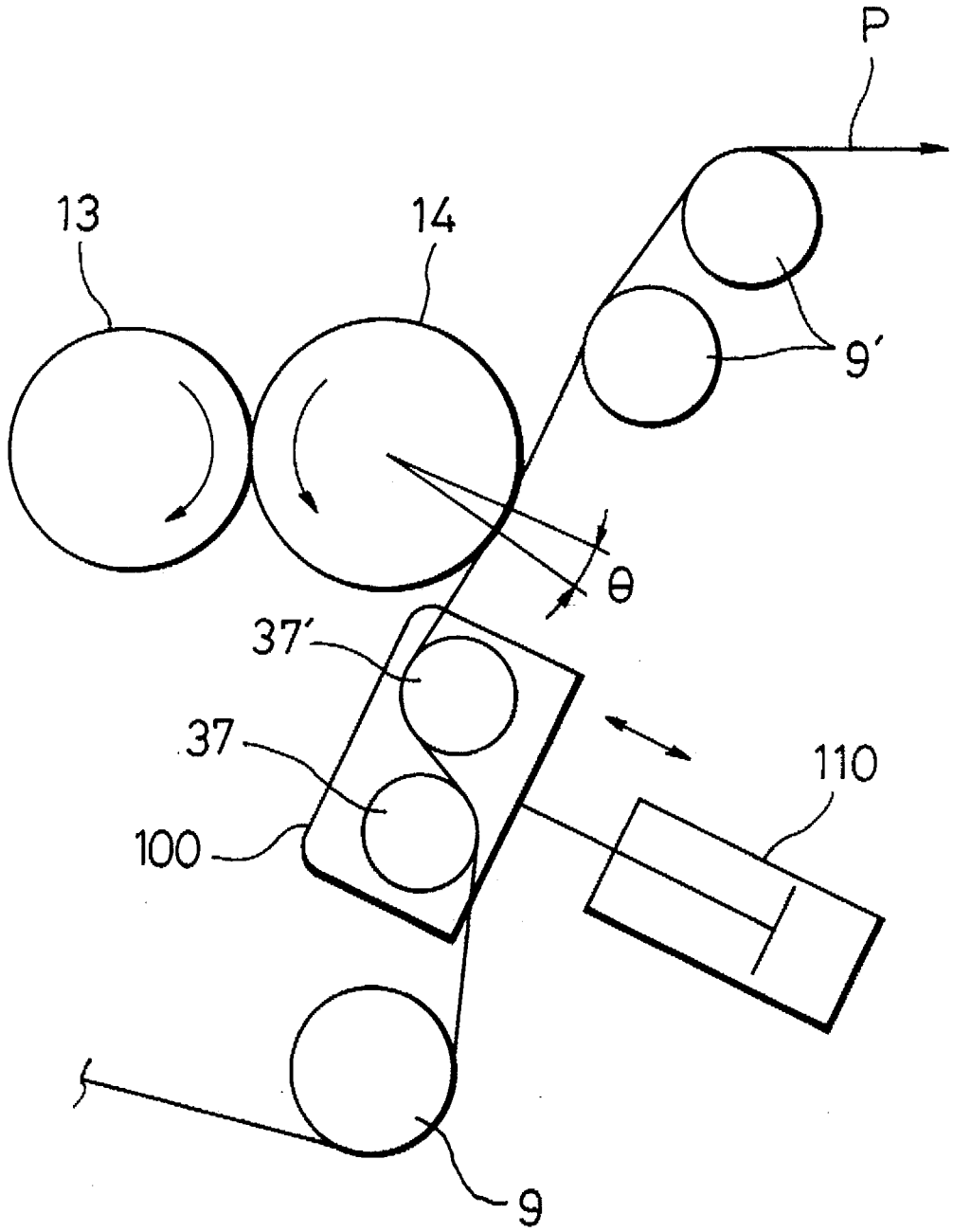
FIG. 8 is a schematic view showing an essential part of a modification of the paste transfer apparatus shown in FIGS. 1 and 3.
Figure 9:
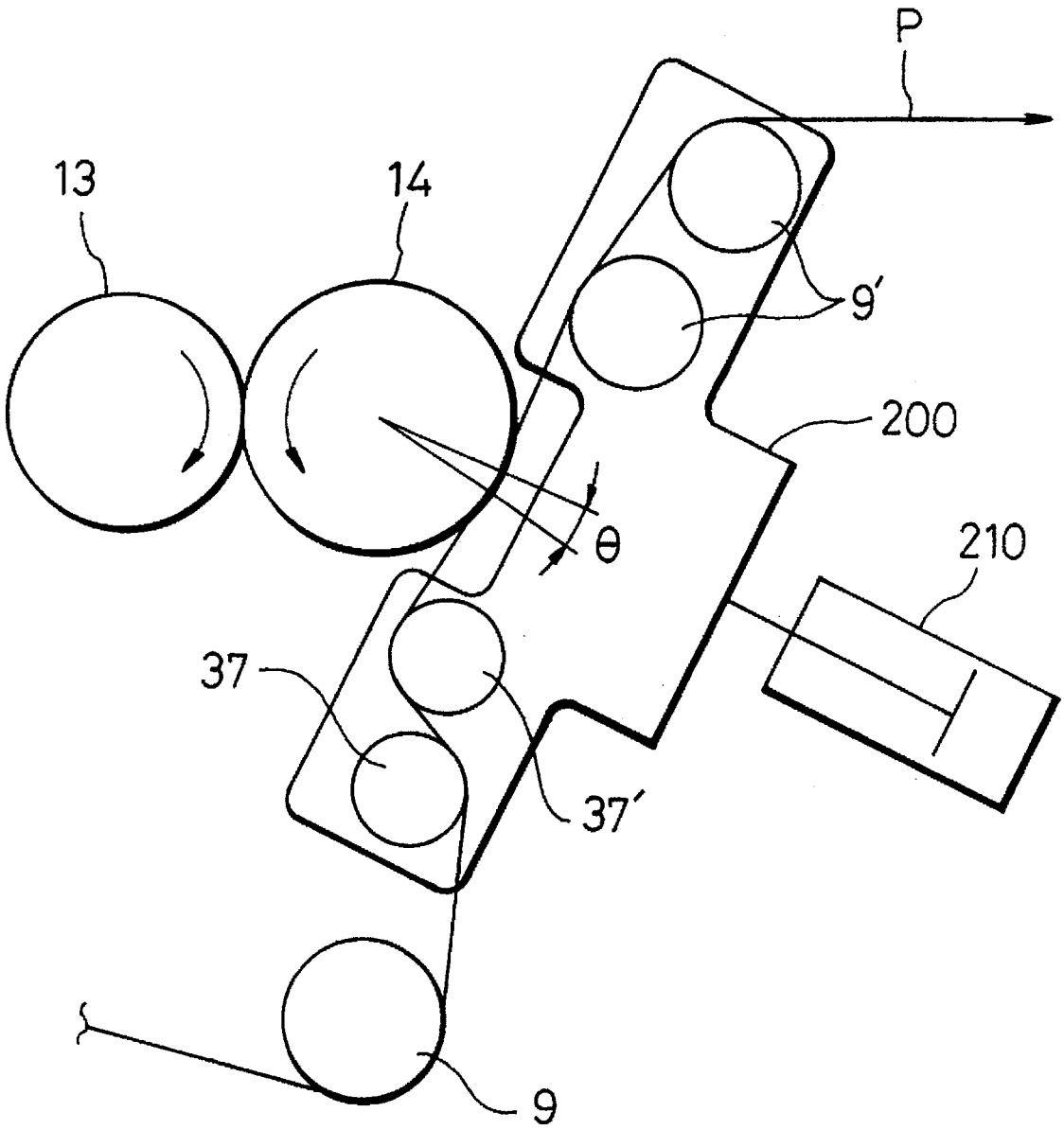
FIG. 9 is a view, similar to FIG. 8, showing another modification of the apparatus.

For example, in the above embodiment, the rocking arm 38 having the movable guide rollers 37 and 37' mounted thereon is turned to thereby move the rollers 37 and 37' toward or away from the paste transfer roller 14. Alternatively, as shown in FIG. 8, the guide rollers 37 and 37' may be mounted on a movable member other than the rocking arm, for example, a linearly movable member 100, and the movable member 100 may be caused to make linear motion by a linear actuator 110. FIG. 9 shows an arrangement of a type where a linear movable member 200 on which the first guide roller means 37, 37' and the second guide roller means 9' are mounted is linearly moved back and forth by a linear actuator 210.

Each of the actuators 110, 210 corresponding to the actuator 42 shown in FIG. 4 is connected to elements (not shown) corresponding to the elements 50 through 55 shown in FIG. 4. Under the control of the control unit 50, each actuator 110 or 210 operates to change the distance by which the movable member 100 or 200 is moved in accordance with the tip paper traveling speed to thereby variably change the contact angle.

Further, although in the embodiment the rocking arm 38 is turned indirectly by the rotary actuator 42 through the cam follower 40 and the swing arm 41, the arm 38 may be directly turned by the rotary actuator 42.

Furthermore, various types of rotary actuator such as a hydraulic actuator or an electric actuator may be used in place of pneumatic rotary actuator. Also, when controlling the rotational position of the rotary shaft of the rotary actuator, feedback control is not essential wherein the difference between the target rotational position and the rotational position sensor output (actual rotational position) is made zero. In the case of using an electric actuator, for example, the rotational position of the rotary shaft of the actuator may be subjected to open-loop control.

In the foregoing embodiment, the contact angle is automatically changed by means of the driving means which is responsive to the speed sensor output, but manual control may be performed instead. In this case, manual valves are used in place of the electromagnetic valves 51 and 52 operated under the control of the control unit 50.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A paste transfer apparatus for transferring paste to tip paper traveling along a tip paper transport path of a filter attachment machine of a filter cigarette manufacturing system, the apparatus comprising:

first and second guide roller means, separated from each other in a tip paper traveling direction, for guiding the tip paper;

a paste transfer roller disposed for rolling contact with the tip paper at a location between said first guide roller means and said second guide roller means, for transferring paste supplied thereto to the tip paper;

a detector for generating an output indicating a tip paper traveling speed; and contact angle changing means for moving at least one of said first and second guide roller means toward and away from the tip paper to change a contact angle over which the tip paper is brought into contact with said paste transfer roller, said contact angle changing means changes the contact angle in accordance with the output of said detector.

2. The paste transfer apparatus according to claim 1, wherein said contact angle changing means includes at least one rocking arm capable of rocking motion and supporting said at least one guide roller means, and driving means for causing said at least one rocking arm to make rocking motion.

3. The paste transfer apparatus according to claim 2, wherein said driving means changes an angle by which said rocking arm is turned, in accordance with the output of said detector.

4. The paste transfer apparatus according to claim 1, wherein said contact angle changing means includes at least one movable member disposed for linear motion and supporting said at least one guide roller means, and driving means for causing said at least one movable member to make linear motion.

5. The paste transfer apparatus according to claim 4, wherein said driving means changes a distance by which said at least one movable member is moved, in accordance with the output of said detector.

6. The paste transfer apparatus according to claim 1, further comprising a paste supply roller adjacent the paste transfer roller, a gap being defined between an outer peripheral surface of the paste supply roller and an outer peripheral surface the paste transfer roller, the gap corresponding to a thickness of a paste layer to be transferred to the tip paper.

7. The paste transfer apparatus according to claim 6, wherein the paste supply roller has a recess formed in the outer peripheral surface thereof, the recess of the paste supply roller having a depth corresponding to the thickness of the paste layer.

8. The paste transfer apparatus according to claim 1, wherein the paste transfer roller rotates at a rotational speed which is adjusted such that a peripheral speed of the paste transfer roller is equal to the traveling speed of the tip paper.

* * * * *